United States Patent [19]

Adams et al.

[11] 4,378,911

[45] Apr. 5, 1983

[54] CAGE MILL

[75] Inventors: Thomas O. Adams, Lawrenceburg; Jim A. Henke, Aurora, both of Ind.

[73] Assignee: Wean United, Inc., Pittsburgh, Pa.

[21] Appl. No.: 165,517

[22] Filed: Jul. 3, 1980

[51] Int. Cl.[3] ..... B02C 13/22

[52] U.S. Cl. ..... 241/187; 241/188 A; 241/285 A

[58] Field of Search ..... 277/178, 53; 220/358, 220/378, 252, 325; 241/285 R, 285 A, 285 B, 299, 300, 294, 182, 183, DIG. 30, 188 R, 188 A, 187, 259.1

[56] References Cited

U.S. PATENT DOCUMENTS

| | | | |
|---|---|---|---|
| 518,010 | 4/1894 | Stedman | 241/188 X |
| 1,927,277 | 9/1933 | Canary | 241/188 R X |
| 2,246,902 | 6/1941 | Smith | 241/188 R X |
| 2,376,593 | 5/1945 | Hellen | 220/378 |
| 2,539,775 | 1/1951 | Gordon | 241/188 R |
| 2,666,092 | 1/1954 | Balzer | 220/325 X |
| 3,441,166 | 4/1969 | DeFrees | 220/378 X |
| 3,659,793 | 5/1972 | Stephenson et al. | 241/188 A X |
| 3,944,091 | 3/1976 | Tillmanns | 241/285 A |
| 4,226,375 | 10/1980 | Cameron | 241/285 B X |

FOREIGN PATENT DOCUMENTS

| | | | |
|---|---|---|---|
| 667972 | 4/1938 | Fed. Rep. of Germany | 241/188 A |

*Primary Examiner*—Mark Rosenbaum
*Attorney, Agent, or Firm*—Daniel Patch; Suzanne Kikel

[57] ABSTRACT

An improved design for a cage mill for disintegrating or reducing materials such as ore, grain, etc., consisting of a movable and a stationary portion for housing two cooperative rotatable cage assemblies mounted on coaxial shafts, and each having two rows of impact members alternating with those of the other cage assembly. The axial length of the impact members increases radially outwardly from the axis of the two shafts, and a disk for each cage assembly has a stepped portion for mounting the longer row of impact members and the ends of the members are protected by impact rings. The stepped portion provides an offset area for nesting the ring of a preceding row to protect the ring against abrasion. For each cage assembly a tapered split ring nut arrangement at the end of the shaft forces the cage against a hub rigidly secured to the shaft, and a locking means secures the nut to the shaft. The power means for rotating the cage assembly associated with the movable portion is mounted on the movable portion for movement therewith, and the sealing element between the movable and stationary portions of the housing is designed to always maintain a positive sealing condition yet allow for misalignment of the two portions.

21 Claims, 8 Drawing Figures

CAGE MILL

BACKGROUND OF THE INVENTION

The present invention relates to a new and novel design for a cage mill for grinding and reducing material such as ore, grain, clay, rock, etc., and particularly to a cage mill which has a stationary and movable housing portion for easy access to and removal of two cooperative cage assemblies from the mill which cage assemblies are mounted on shafts for rotation in opposite directions.

Several major problems are inherent in the designs of past cage mills as exemplified in U.S. Pat. Nos. 3,028,105; 3,047,243; and 3,503,561. First, the housings of the cage mills consist of several pieces joined together thus requiring a large number of complex sealing joints to be maintained to keep dust from escaping from the grinding chamber. In addition, the main drive motors and drives are located remotely from the cage mill, thereby requiring a disassembly of the V-belts and guards from the main drive motors when the movable side of the housing is retracted from the stationary side. It is therefore, an object of the present invention to substantially reduce downtime of the machine, more particularly separating the housing to allow access to cages and other internal members, without requiring any disconnecting of drive components.

It is another object of the present invention to provide a simplified construction for the cage mill housing consisting of a movable and a stationary portion and requiring a sealing between only these two components, and permitting easy retraction of the movable portion since the main drive motors and drives are mounted on the pedestal of the movable portion for movement therewith.

Another object of the present invention is to provide a substantially continuous sealing arrangement located externally around the perimeter of the housing where the movable and stationary portions come together, and consisting of a rigid lip which is engaged deeply into a cross-sectional area of a pliable material to always maintain a positive sealing condition, yet allowing for any misalignment which may exist between the two housing portions.

Secondly, in the cage mill designs of U.S. Pat. Nos. 3,028,105 and 3,503,561, the mounting of a cage assembly or rotor on a shaft is done by bolting the cage assembly to a hub mounted on the shaft. The hub has a bolting flange and a machined shoulder to which the cage is fitted. Since the cage assemblies and hub are exposed to the environment of the grinding chamber, corrosion normally occurs between the cage bore and the machined shoulder on the hub, making cage assembly removal for replacement or repair of any components in the housing chamber very difficult and time-consuming.

It is therefore a further object of the present invention to provide a means for easily securing and releasing the cage assembly from the hub and shaft, thereby reducing the time and eliminating the difficulty involved when removing and replacing the cage assemblies in the mill.

More particularly, a tapered nut element is used to expand a heat treated steel split ring into the bore of the cage assemblies and hub, thus holding the cage assembly centered with and against the face of the hub. Removal of the nut element causes the split ring to contract, thereby releasing the cage assembly from the hub.

Thirdly, the impact members of the cages in U.S. Pat. Nos. 3,028,105 and 3,503,561 are the same length in rows 2 and 3 radially outwardly from the axis of the shafts, which means that the ring supporting one end of the members are located in the path of the material to be pulverized. Consequently, the rings are subjected to severe abrasion. To combat this problem these patents disclose the use of rolled bands of steel, each band located at the periphery of a row of sleeves and welded to the adjacent disk in order to protect the ring of the next row. However, the band is relatively thin due to limitation of space in the area where the band is located, consequently abrasion of the rings still occurs resulting in a very short service life of the band.

A still further object, therefore, of the present invention is to provide permanent protection against abrasion for the cage rings, and more importantly, a increase in the pulverizing efficiency of the cage mill.

More particularly, the two primary disks to which the impact members are connected are of a stepped configuration providing an offset for receiving the rings of the next row. By increasing the axial length of the impact members of the second, third, and fourth rows, the cage rings of rows 2 and 3 are nested in the offsets. This provides protection of the ring against abrasion and creates a smooth flow path for the material passing through the cages.

Another object of the present invention is to provide a means for achieving a nested relationship of the rings of one cage assembly in the offsets formed by the other cage assembly. This means involves axial movement of the shaft to which the cage assembly is mounted.

The newly established increased axial length of the impact members increases the cross sectional area of the space between rows. This affords the material more space to which to be disbursed, thereby providing improved impacting conditions.

These and other objects of the present invention will be better understood and appreciated when the following description is read along with the drawings of which:

FIG. 1 is a partly broken away elevational view of the cage mill of the present invention showing in phantom the positioning of the movable portion of the housing when in a retracted position away from the stationary portion;

FIG. 1*a* is an enlarged view of the clamping assembly for holding the movable portion of the housing against the base, which assembly is shown in FIGS. 1 and 2;

Figure 3:
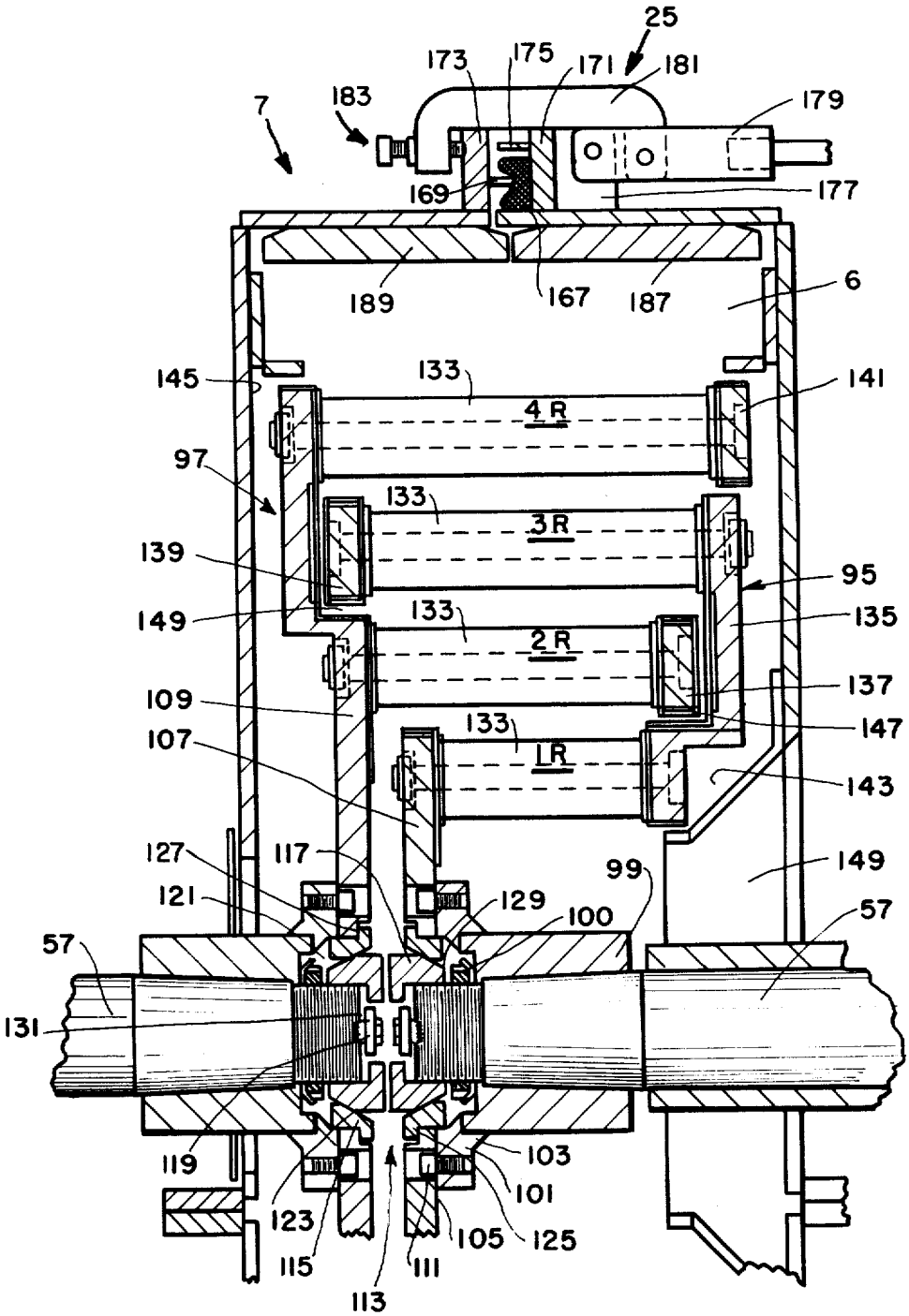
FIG. 3 is a cross sectional view taken longitudinally down through the cage mill housing shown in FIG. 1.
Figure 3A:
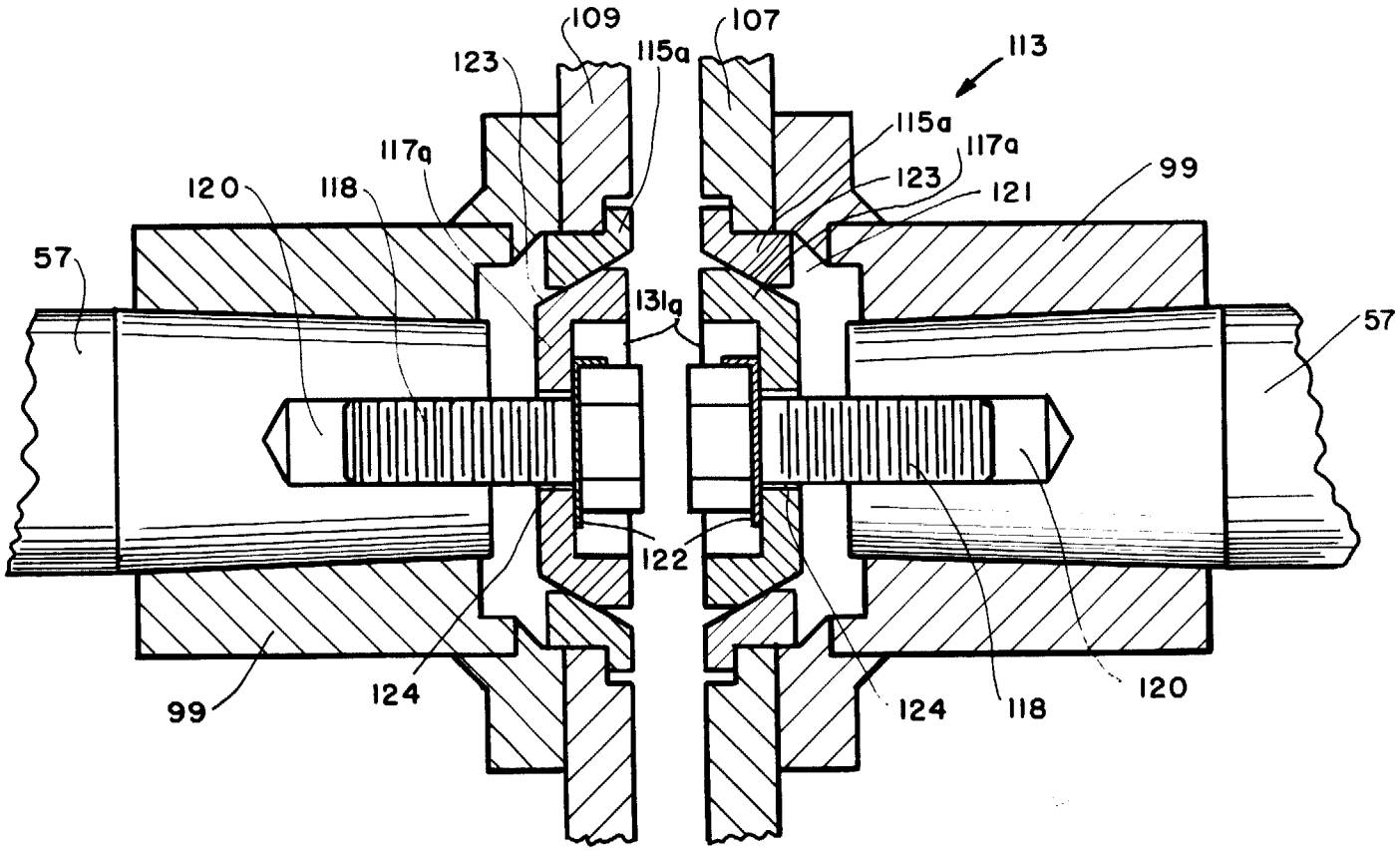

FIG. 3*a* is a second embodiment for securing the cage assembly on the shaft shown in FIG. 3.

Figure 1:
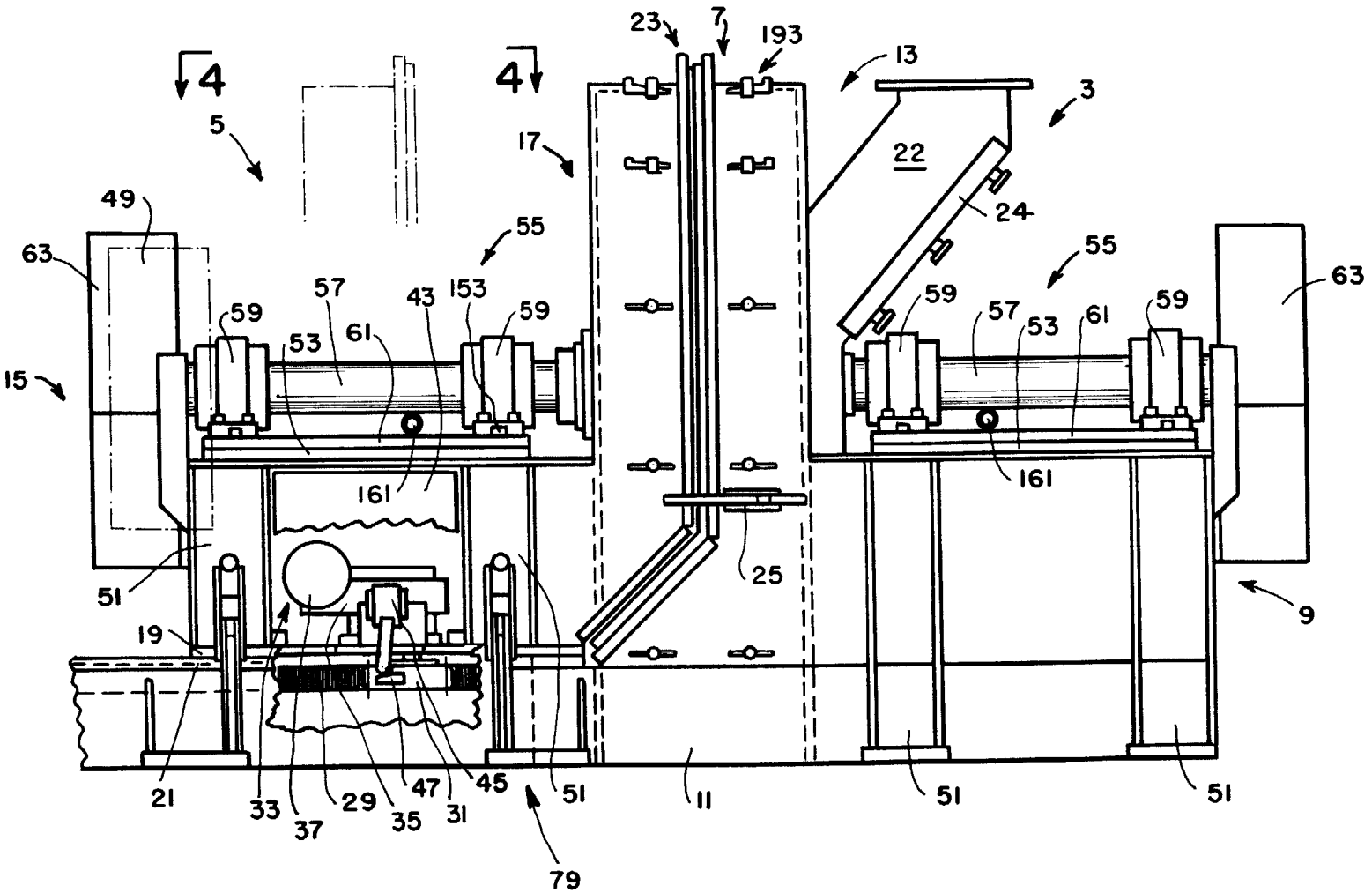
Figure 4:
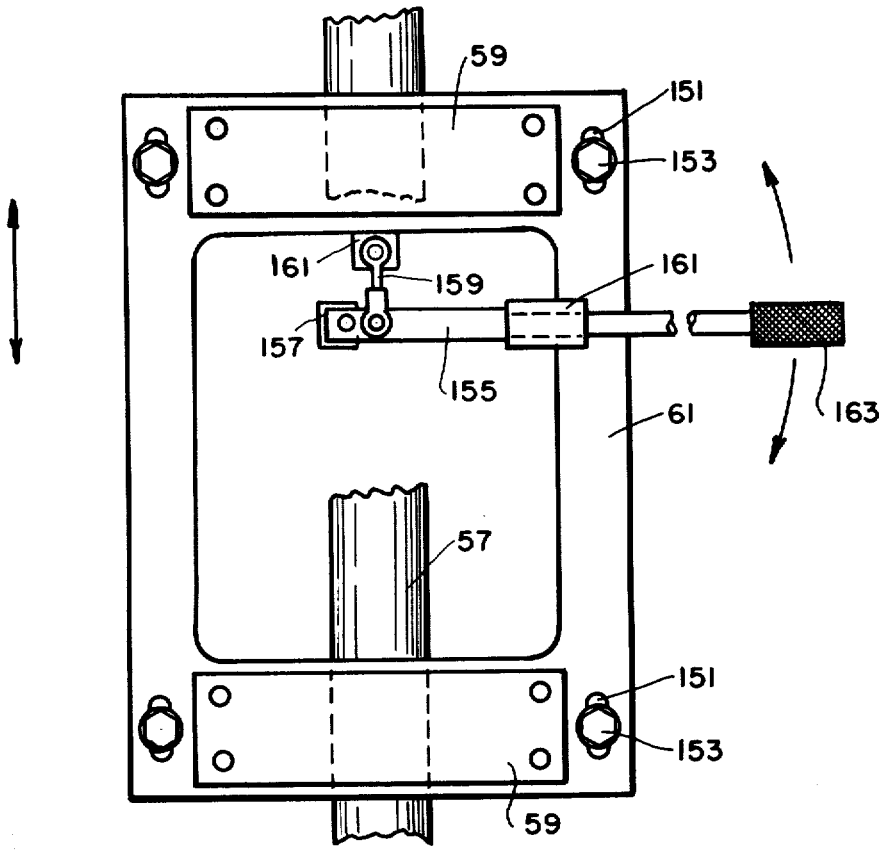
Figure 5:
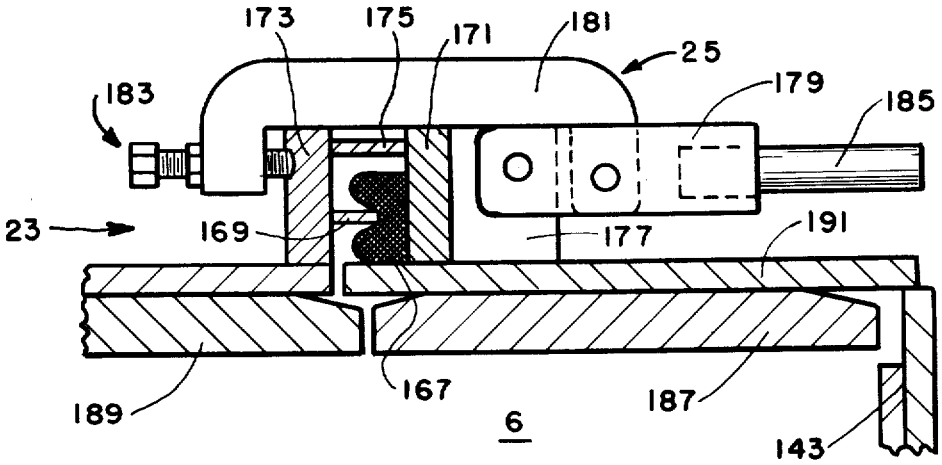
Figure 6:
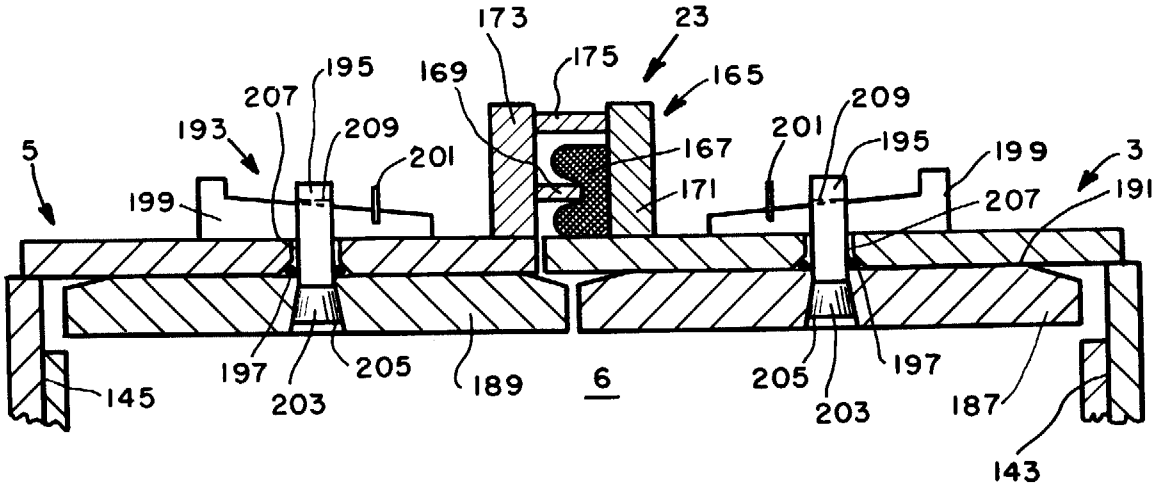

FIG. 4 is a plan view viewed along lines 4—4 of FIG. 1;

FIG. 5 is an enlarged sectional view of the upper portion of FIG. 3 illustrating a sealing arrangement and its clamping assembly;

FIG. 6 is an enlarged sectional view of the top of the housing of the cage mill shown in FIG. 1 taken longitudinally down through the cage mill housing shown in FIG. 1.

Figure 2:
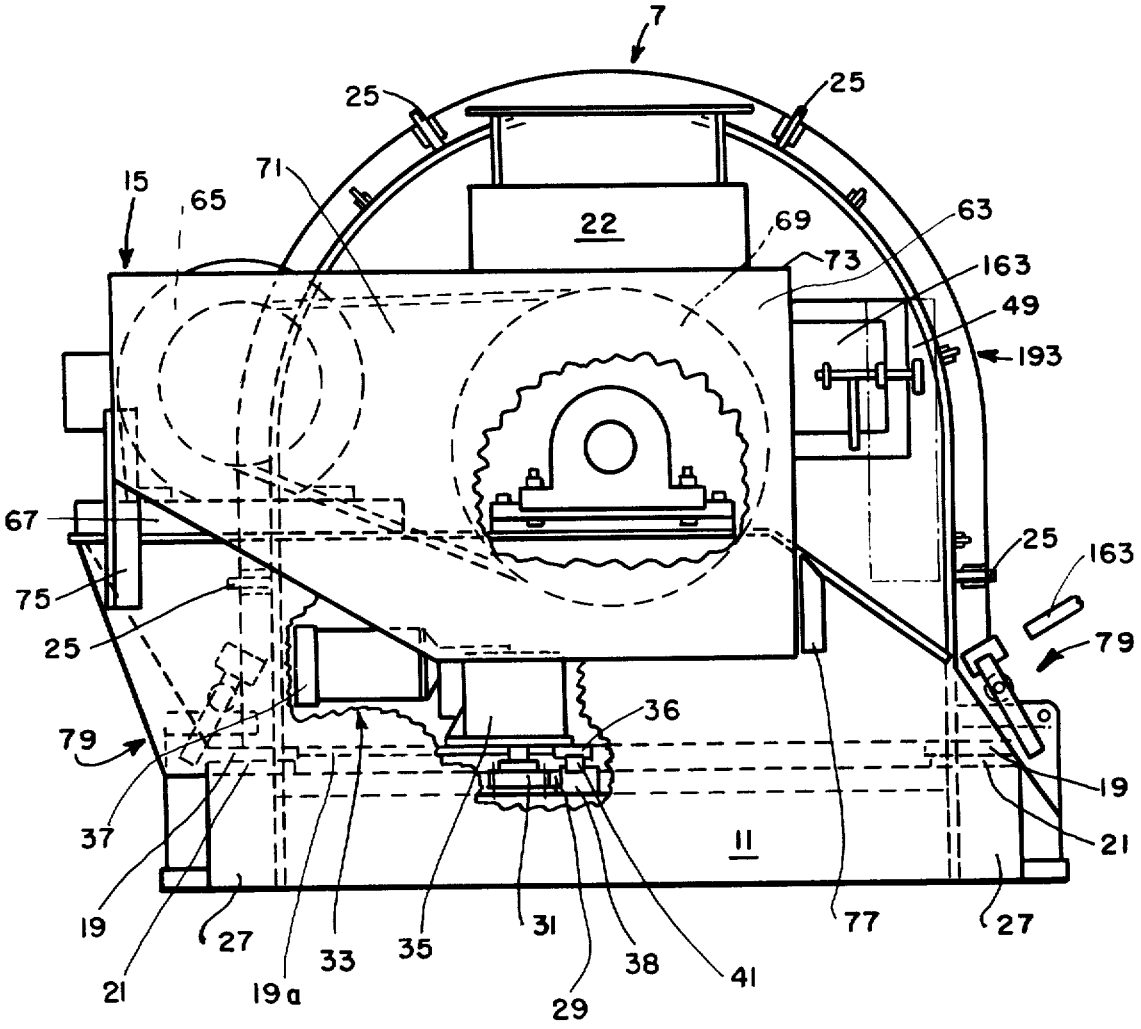
FIG. 2 is a partly broken away side elevational view of the cage mill of the subject invention.

FIGS. 1 and 2 illustrate some external novel features of the present invention, and FIG. 3 illustrates some internal novel features of the present invention. Even through two cage assemblies, each having two rows and forming a four-row type mill are illustrated herein, it is to be understood that generally all of the features of the present invention can be incorporated in any type cage mill.

Many of the features of a cage mill are well known in the art, particularly in the aforesaid patents, and, therefore, need no further explanation.

Referring first to FIG. 1, there is shown a new design for a cage mill, which is of a two-piece construction. The mill consists of a stationary portion 3 shown to the right, and a movable portion 5 shown to the left of FIG. 1. These two portions come together in a unitized manner to form a grinding chamber 6 (shown in FIG. 3) of housing 7. Stationary portion 3 consists of a shaft support pedestal assembly 9, a base 11, and a feed side 13 of the grinding chamber housing 7, and these three sections are fabricated into an integral piece by welding or casting. Movable portion 5 has a shaft support pedestal assembly 15 and a plain side 17 of the grinding chamber housing 7, and these two sections are also fabricated into an integral piece by welding or casting. As can be seen, a baseplate 19 of movable portion 5, is supported on a plate 21 of base 11 of stationary portion 3. Movable portion 5, positioned immediately adjacent to stationary portion 3, defines a closing or operating mode for the mill. A continuous joint is formed between these two portions 3 and 5, and a sealing arrangement 23 runs all along this continuous joint, (more about which will be discussed later). It should be noted that the two vertical straight portions and the large radius of upper portions of the two portions 3 and 5 provide the best possible manner of allowing for the creation of an effective sealing of the housing.

The feed side 13 consists of a hopper 22 for receiving and directing the material to be ground into the chamber 6. Inspection of this material and the chamber can be made through door 24 located on hopper 22.

The plain side 17 of housing 7 moved away from stationary portion 3 is shown in phantom in FIG. 1. This is an open positioning or a non-operating mode for the cage mill. The two integral pieces 3 and 5 of the cage mill are locked together through several clamping assemblies 25, one of which is shown in FIG. 1 to be in cooperating with sealing arrangement 23. FIG. 2 shows the upper portion of the housing 7 to be of a round configuration, and as having a total of four such clamping assemblies 25 arranged circumferentially around the outside of housing 7 (more about which will be explained later).

As can be seen in FIGS. 1 and 2, base 11 is formed into a rectangle by hollow rigid supports 27 also rectangular in form and baseplate 19 of movable portion 5 and plate 21 of base 11 extend between supports 27 as particularly shown in FIG. 2. Movement of movable portion 5 is through a rack and pinion arrangement. The rack 29 is supported in bar 38 of base 11 and both extend a distance to enable movable portion 5 to be moved away from stationary portion 3 the required distance for access into chamber 6. Directly below the grinding chamber 6 in the base 11 is the customary material discharge opening (not shown in any of the Figures).

Pinion 31 is driven by a retractor unit 33 consisting of a reducer 35 and a motor 37, and is carried by movable portion 5 by being mounted on baseplate 19A so as to require no disconnection of parts when portion 5 is moved. Engagement of the pinion 31 with rack 29 is assured through guiding means having a guideway 36 mounted to baseplate 19A. A key element 41 is attached to guideway 36 and engages into a keyway in bar 38. Access to this unit is made through a door 43 located in shaft supporting pedestal assembly 15 of movable portion 5. A limit switch 45 activated by an arm-cam arrangement 47 on retractor unit 33 sends a signal to control box 49 to interrupt the power for retractor unit 33 when movable portion 5 abuts stationary portion 3. Control box 49 for retractor unit 33 is shown in dash-dot lines to eliminate complexity to the FIGS. 1 and 2; however, it is mounted to movable portion 5.

As shown in FIG. 1, pedestal assemblies 9 and 15 consist of two rigid legs 51 forming a space therebetween wherein in pedestal assembly 15, retractor unit 33 is located. The two legs 51 extends the width of base 11 and support a plate 53, which in turn, support shaft assemblies 55. Shaft assemblies 55 consist of a shaft 57 supported by two bearing assemblies 59. Bearing assemblies 59 are bolted to a sub-plate 61, and sub-plate 61 is bolted to plate 53.

Located at the outward end of each shaft 57 is a power unit 63 for rotating the shaft of that assembly. Power unit 63 is mounted alongside shaft support pedestal assemblies 9 and 15. As seen in FIG. 2, motor 65 of power unit 63 is supported on a shelf 67 extending outwardly from the side of the pedestal assemblies 9 and 15. Power is transmitted from the motor drive to shaft 57 via a sheave 69 and V-belts 71. A substantially rectangular drive guard 73 is placed over power unit 63 and securely bolted to the side of pedestal assemblies 9 and 15 through extensions 75 and 77 located on either side of the guard 73 as shown best in FIG. 2. As noted, this design of the power unit 63 secured to the shaft support pedestal assembly enables movement of movable portion 5 without removal of the V-belts and guard.

Figure 1A:
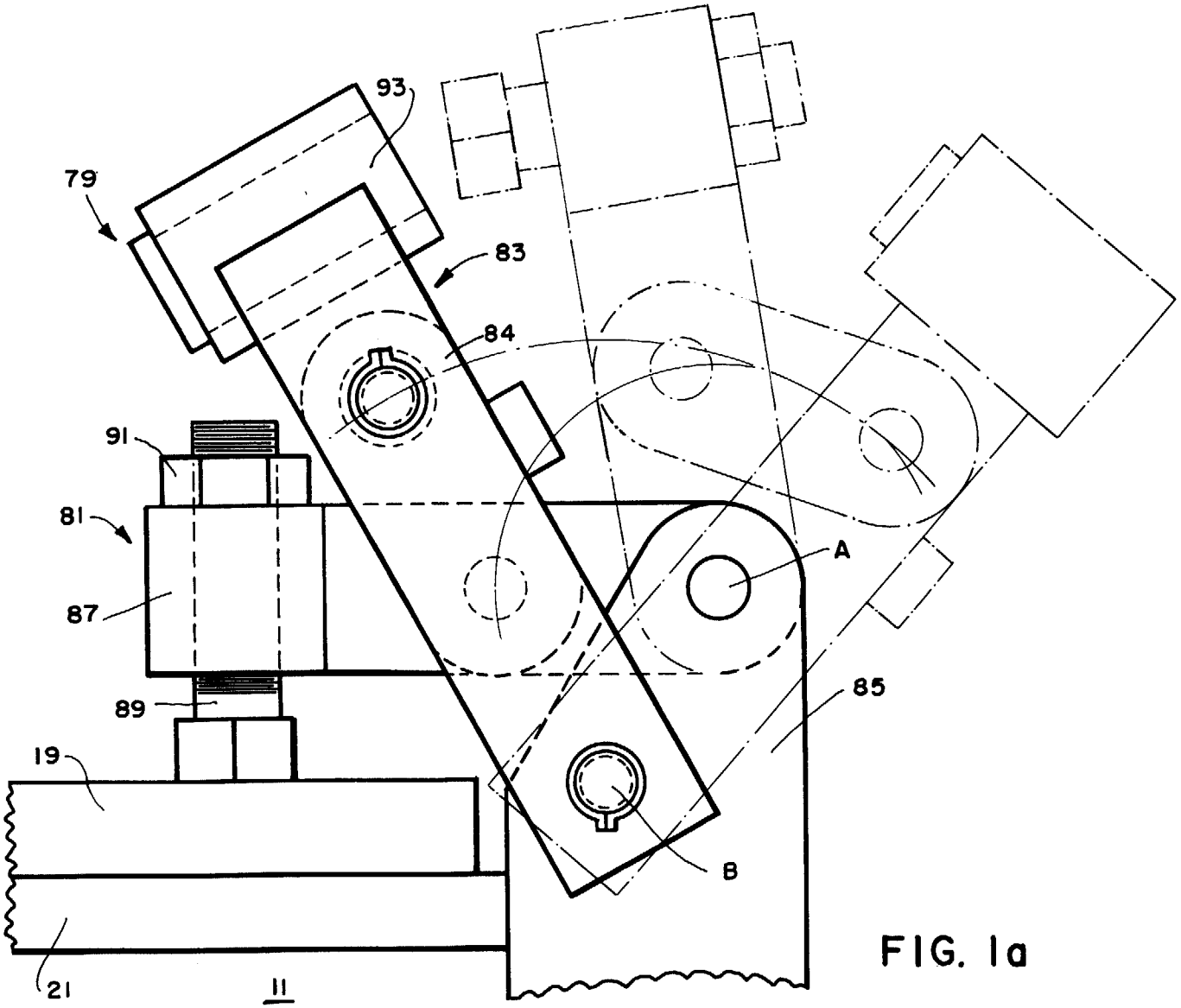

Movable portion 5 is held in place on base 11 through clamping assembly 79, shown in FIGS. 1 and 2, which forces the undersurface of baseplate 19 against top surface of plate 21 of base 11. At least two such assemblies 79 are located on either side of the movable portion 5. The construction of clamping assembly 79 is best shown in FIGS. 1 and 1*a*. Arm assembly 81 extends into arm assembly 83 and both are interconnected through links 84. Arm assembly 81 consists of a single solid bar and 83 consists of two parallel spaced apart arms. Arm 81 fits into and is pivotally connected to bracket 85 at point A, and the arms of assembly 83 are pivotally connected to bracket 85 at point B. Bracket 85 extends down alongside base 11. Secured to the end of arm 81 is a holding portion 87 for extending an adjustment screw 89 therethrough. The head of adjustment screw 89 abuts a top surface of baseplate 19 and a jam nut 91 provided locks the adjustment screw 89 to the holding portion 87. A tubular handle holding portion 93 is welded to the one end of assembly 83. An unlocking mode for clamping assembly 79 is shown in phantom in FIG. 1*a*. To obtain this unlocking position, a portable handle, shown in FIG. 2, is inserted into holding portion 93 of arm assembly 83 and pulled back away from the mill to the position shown in phantom in FIG. 1*a*. For a locking position, the handle is pushed toward the mill until head of jam screw 89 abuts baseplate 19.

In FIG. 3, shafts 57 extend into housing 7 to support cage assembly 95, 97. As is known in the art, cage assemblies 95 and 97 are rotated in opposite direction to develop the impact action on the material. This coaxially positioning of the two shafts 57 is assumed when the movable portion 5 abuts stationary portion 3 and the mill is in an operative mode. Each shaft 57 has a tapered or alternatively cylindrical portion and a threaded portion at its one end extending into the housing 7. Each cage assembly 95, 97 is rotatably mounted to shaft 57 through a flanged hub 99 which has an inner surface corresponding to that of shaft 57. Hub 99 is rigidly secured around its mounting portion of the shaft 57 and kept in position by nut 100. The flange 101 is welded to hub 99 and has a machined shoulder 103 and a face 105 to which rigid disk 107, 109 of cage assembly 95, 97 respectively abuts against. Hub 99 contains two driving pins 111 for roughly locating the cage assembly onto the hub and transmitting the driving torque of shaft 57 to the cage assembly 95, 97.

Retaining device 113 at the end of each shaft 57 consists of a split ring 115, a tapered nut 117, and a rectangular locking plate 119. Split ring 115 is made of heat treated steel. It is slightly smaller in O.D. than the outer perimeter of the bore 121 formed by each cage assembly on their respective hub, has a tapered surface 123 on its I.D. and is easily fitted into bore 121. A flange 125 of split ring 115 abuts against a shoulder 127 of cage assembly 96, 97. At one end, tapered nut 117 has a tapered surface 129 around its O.D. corresponding to the tapered surface 123 of split ring 115, and a slot 131 extending across its diameter. It also has internal threads and when tightened onto shaft 57, its tapered surface 129 engages tapered surface 123 and causes ring 115 to expand into bore 121, thereby centering the cage assembly 95, 97 with the hub 99, and at the same time securing the cage assembly and hub onto the shaft 57. Tightening of nut 117 onto the shaft 57 is done through the use of a steel bar fitted into the slot 131 which bar is manually rotated by the operator of the mill.

To prevent rotation of nut 117, a locking plate 119 is positioned into slot 131 and bolted into a tapped hole in the shaft. On each side of the bolt, two jaw grippers are set into the underside of plate 119 to grip the end of the shaft. These grippers are made of tungsten carbide and have diamond patterned grips, and are purchased as a standard item through Reid Tool Supply Co., Muskegon Heights, Mich.

To remove either cage assembly 95, 97 from shaft 57, lock plate 119 is removed and nut 117 is loosened causing split ring 115 to contract thereby decreasing its holding force of the cage assembly against the hub flange 101.

FIG. 3*a* illustrates an alternate design for retaining device 113 shown in FIG. 3. It consists of a tapered split ring 115*a*, a tapered nut 117*a*, and a bolt 118 engageable in a threaded hole 120 in shaft 57. The design of split ring 115*a* is similar to that of split ring 115. However, tapered nut 117*a* and the means for fastening it to shaft 57 differs from tapered nut 117. Nut 117*a* has a tapered surface corresponding to tapered surface 123 of ring 115, a counterbore 131*a* in its diameter, and an axial bore 124. Bolt 118 is received in counterbore 131*a* and extends into bore 124 into threaded hole 120 in shaft 57. This design operates in the same manner as the design shown in FIG. 3 to expand and contract split ring 115*a*. Rotation of bolt 118 is prevented by element 122 having an upward edge abutting the head of the bolt. Element 122 is a thin washer which is prevented from turning by means of a tab which engages into a small slot located adjacent to the bore 124 in nut 117*a*. This design eliminates the use of the steel bar and therefore may find practical application in the smaller cage mills where working space is minimal.

Turning now to describing the construction and novel features of cage assembly 95, 97 reference is still made to FIG. 3. Cage assembly 95 has two rows of cylindrical impact members 133 alternating with two rows of impact members 133 of cage assembly 97. The rows of impact members of cage assembly 95 are indicated as 1R and 3R, and are respectively the inner and outer rows of that assembly, and those of cage assembly 97 are indicated as 2R and 4R, and are respectively the inner and outer rows of that assembly. As can be seen, the axial length of the impact members increases progressively from row 1R to row 4R. The impact members of row 1R have an axial length less than those of row 3R. The members of rows 1R and 3R are supported at their one end when viewing FIG. 3 by disk 135. The axial length of impact members of row 2R is less than that of the members of rows 3R or 4R. The members of rows 2R and 4R are supported at their one end by disk 109. Each row of impact members is circumferentially arranged around their respective supportive disk, and each member of each row is equally spaced therearound. Impact members of row 1R are supported at their other ends by disk 107 which, as mentioned previously, is secured to shaft 57 of cage assembly 95. Those of rows 2R, 3R and 4R are rigidly supported at their other ends by rings 137, 139 and 141, respectively.

Disks 109,135 do not have continuous straight outer surfaces relative to the inner wall of the housing, but rather have a stepped inward portion as clearly shown in FIG. 3.

On the inward side of both disks 109 and 135, this stepped configuration provides an inverted area or an offset for receiving a ring supporting a row of impact members alternating with the two rows supported by the disk. For instance, disk 135 has an offset area 147 into which ring 137 of the impact members of row 2R nests, and disk 109 has an offset area 148 into which ring 139 of the impact members of row 3 nests. The length of the members of row 4R is such that ring 141 is substantially in alignment with disk 135, out of the flow path of the material being reduced. The nesting of rings 137, 139 and the alignment of ring 141 with disk 135 provides a high degree of protection for the rings against abrasion which is normally caused by the material during its flow through its path of travel which is radially outwardly away from the axis of the shafts to the outer periphery of the chamber 6.

It has been found through experience that several high wear zones exist in the flow path of the material, for example, around rings 137, 139 and 141. For added protection against abrasion, as indicated by one or several thicknesses in the material flow area, a single or a double band of a hard surface alloy is applied through a welding process to the rings and to the surfaces of disks 107, 109, 135 which are exposed to the material during the grinding process. The construction of the impact members and their securement to the disks and rings can be similar to that shown in the aforesaid U.S. Pat. No. 3,503,561, and therefore, no further discussion is necessary.

Opening 149 directly below disk 135 and to the right of FIG. 3 communicates with hopper 22 of stationary portion 3 to feed the material into the center of the chamber 6. As is known in the art, centrifugal forces caused by the rotation of cage assemblies 95 and 97 throw the material radially outwardly. The positioning of rings 137, 139 and 141, and the bands of a material highly resistive to abrasion as discussed above results in less wear, and therefore, less replacement of the components of the cage assembly 95,97, and an increased efficiency of the cage mill.

In order to assure the proper cooperation of the cage assemblies 95, 97 and more particularly, the desired positioning or nesting of rings 137, 139 and 141, the present invention provides for the vernier axial adjustment of one or both cage assemblies relative to the other. This adjustment is made through sub-plate 61 whose construction is clearly shown in FIG. 4. This sub-plate 61 was described earlier in the description of FIG. 1 as supporting bearings 59 of shaft 57 and bolted to plate 53 on pedestal assembly 9,15 on movable and stationary portions 3,5 respectively of housing 7.

Holes 151 through which bolts 153 extend down into plate 53 are slotted to permit a predetermined movement of sub-plate 61 in both axial directions as indicated by the double headed arrow. Movement of sub-plate 61 is accomplished through a lever-mechanism. Lever-mechanism consists of an arm 155 pivotally connected at one end to a support block 157 mounted on plate 153, and a link 159 connected to an extension 161 connected to sub-plate 61. Mounted at the other end of arm 155 is a holding element 161 for receiving a portable handle 163, which is the same handle used in clamping assembly 79. To initiate movement of the shaft assembly 55 (FIG. 1), handle 163 is inserted into holding element 161 and, as shown by the arrows, is rotated in the appropriate arcuate direction. This axial movement of the shaft is minimal so that the connection of the components of power units 63 to shaft assemblies 55 is not in any substantial way disturbed.

FIG. 1 illustrates both shaft assemblies 55 as being mounted on movable sub-plates 61. However, in some cage designs, it may not be necessary to provide two movable sub-plates 61. A visual inspection of the positioning of the cage assemblies 95, 97 can be made by the operator of the mill through door 163 (best shown in FIG. 2) which is located in feed side 13 of stationary portion 3, and by this inspection the proper positioning of the cages can be achieved.

FIGS. 5 and 6, as well as FIG. 3, illustrate in detail the construction of sealing arrangement 23 shown schematically in FIG. 1. This arrangement 23 is located externally of housing 7 and consists of a seal holding element 165, seal 167, and lip 169. Holding element 165 has a rigid member 171 mounted on stationary portion 3, a rigid member 173 mounted on movable portion 5, and a rigid stop member 175 mounted to member 173 and extending between this member 173 and member 171. Seal or gasket 167 adheres to and extends the entire length of rigid members 171, 173, and 175 which extend around the perimeter of the relevant part of the housing and has a substantially large cross-sectional area compared to lip 169. It is made of a soft durometer rubber or is a cellular sponge. Lip 169 is welded to and extends the entire length of rigid members 171, 173 and 175, and is made of steel. Members 171, 173 and 175, lip 169 and seal 167 take the same arcuate form as that of the housing outlined in FIG. 2, and slants downwardly on either side of the housing 7 as shown in FIG. 2.

When the mill is opened and movable portion 5 moves toward stationary portion 3, lip 169 engages into seal 167. Because of the small contact area of lip 169, a minimal amount of force is necessary to accomplish this engagement. Member 175 limits the distance lip 169 can travel into seal 167 when it abuts member 171, and it also protects seal 167. The clamping assembly 25, mentioned earlier, and shown in detail in FIG. 5 maintains the lip in engagement with the seal. It will be appreciated that even though there may be some misalignment between the two housing portions 3 and 5, that a seal can still be established and maintained in view of the ratio of the cross-sectional areas of the lip and the seal, and the normal central positioning of the lip relevant to the seal.

Clamping assembly 25 is mounted to stationary portion 3 by a support block 177 adjacent to member 171. Pivotally connected to block 177 is a yoke 179 into which one end of a C-shaped member 181 is pivotally mounted. At the other end of C-shaped member is a screw and nut arrangement 183 wherein the screw enters a pilot hole in member 181. The screw and nut arrangement 183 adjusts the tightening force of the clamping assembly 25. Portable handle 185 is inserted into the end of yoke 179 and manually rotated in a clockwise direction to bring the yoke and handle into the horizontal position shown in FIG. 5. A counter-clockwise movement (relative to viewing FIG. 5) of the handle releases clamping assembly 25 from sealing arrangement 23.

In FIGS. 5 and 6, two liner plates 187 and 189 line the inside of chamber 6 substantially the width of the housing, and are made of a highly abrasive resistant material, such as Nihard. In a housing 29 inches wide, each liner plate would be approximately 9½ inches wide and 15 inches long. These plates 187 and 189 are arranged circumferentially in rows of two against the outer wall 191 of chamber 6. One row is fastened to movable portion 5 and one row to stationary portion 3 by fastening means 193 (shown in FIG. 6) located in the center of each plate 187,189.

Fastening means 193 consists of a pin 195, an O-ring seal 197, a retaining wedge 199, and a hair pin cotter 201. Pin 195 has a slotted end and a frustum 203 corresponding to tapered surfaces of an opening 205 in plates 187,189. Communicating with this opening 205 is a bore 207 in the stationary or the movable portions. Insertion of pin 195 into tapered opening 205 and bore 207 is done through the inside of the chamber 6. As the pin 195 is being inserted, its tapered surfaces mate with the tapered surfaces of opening 205. O-ring seal 197 is sandwiched between liner plate 187, 189 and the outer wall 191 of chamber 6, thereby preventing dust from escaping through the openings 205 in the housing. Retaining wedge 199 is placed into slot 209 and hair pin cotter 201 into retaining wedge. FIG. 1 shows in schematic form the pin and wedge arrangement around the outside of the housing 7.

As is well-known, during the reducing stage the material in the chamber hits against the center of the housing along its width where the liner plates 187 and 189 are located. In providing two rows of plates, each plate can be easily rotated 180 degrees to provide an unworn center. The design of fastening means 193 is conducive in facilitating quick removal and replacement of plates 187, 189.

In accordance with the provisions of the patent statutes, we have explained the principle and operation of our invention and have illustrated and described what we consider to represent the best embodiment thereof.

We claim:

1. In a cage mill for disintegrating or reducing material comprising:

a housing forming a material reducing chamber, two axially opposed shafts each having their one end extended in said chamber, each said shaft includes a hub having a bore for mounting on a complimentary portion of said extended end, cooperating cage assemblies connected to and for rotation with a different one of said hubs, means for maintaining each said hub and its respective cage assembly on their respective shaft comprising:

a split ring arranged concentrically with said extended end portion of said shaft and having inner peripheral and outer peripheral load transmitting surfaces, said latter surfaces engaging with an associated cage assembly in a manner to oppose movement of the hub axially towards the end of the shaft, a nut threadably mounted on the outer end of said shaft having an outer peripheral load transmitting surface for engaging said inner surface of said split ring in a manner to oppose movement of the ring axially toward the end of the shaft, said nut having a central opening including a restricting surface, locking means threadably insertable through said opening of said nut into the end of said shaft having a holding member which said nut in the tendency to rotate is caused to engage to prevent rotation thereof.

2. In a cage mill according to claim 1 wherein said inner peripheral surface of said split ring and said outer peripheral surface of said nut are correspondingly tapered.

3. In a cage mill for disintegrating or reducing material comprising:

a housing forming a material reducing chamber, two axially opposed shafts each having their one end extended in said chamber, each said shaft includes a hub having a bore for mounting on a complimentary portion of said extended end, cooperating cage assemblies connected to and for rotation with a different one of said hubs, means for maintaining each said hub and its respective cage assembly on their respective shaft comprising:

a split ring arranged concentrically with said extended end portion of said shaft and having inner peripheral and outer peripheral load transmitting surfaces, said latter surfaces engaging with an associated cage assembly in a manner to oppose movement of the hub axially toward the end of the shaft, a nut insertable into said split ring having an outer peripheral load transmitting surface for engaging said inner peripheral surface of said split ring, said nut having a central opening including a restricting surface, locking means threadably insertable through said opening of said nut into the end of said shaft and having a holding member which said locking means in the tendency to rotate is caused to engage to prevent rotation thereof.

4. In a cage mill according to claim 3 wherein said holding member is a plate and is held in position by said restricting surface.

5. In a cage mill according to claim 3 wherein said end of each of said shafts also has a threaded portion adjacent to said hub mounting portion, and wherein said nut further includes an inner threadable peripheral portion engagable with said threaded portion of said shaft.

6. In a cage mill according to claim 5 including a second nut means threaded onto said shaft and positioned adjacent to said hub means for assuring said positioning of said hub means on said shaft.

7. In a cage mill according to claim 3 wherein said locking means includes a bolt and said holding member includes a circular member having an opening through which said bolt extends and located between said bolt and said nut in said central opening of said nut and having a portion engageable with the head of said bolt.

8. In a cage mill for disintegrating or reducing materials comprising:

a housing of a unitized construction being made up of two distinct portions which when caused to assume an operative position for said mill, form said unitized construction, said housing also having within it a material reducing chamber for receiving rotating means for reducing said material when introduced into said chamber, said two distinct portions consisting of one portion being stationarily mounted and the other portion being movably mounted relative to each other, power means for rotating said rotating means mounted on said movable portion and movable therewith, retracting means including a second power means mounted in said movable portion and movable with said movable portion for causing said movable portion to move toward and away from said stationary portion and wherein said towards position assumes said operative postion of said mill, base means forming part of said stationary portion of said housing for supporting said movable portion of said housing during its movement, said housing includes two axially opposed shafts each having their one end extending in said chamber, each said shaft including a hub having a bore for mounting on a complimentary portion of said extended end, said rotating means connected to and for rotation with a different one of said hubs, means for maintaining each said hub and its respective rotating means on their respective shaft comprising:

a split ring arranged concentrically with said extended end portion of said shaft and having inner peripheral and outer peripheral load transmitting surfaces, said latter surface engaging with an associated rotating means in a manner to oppose movement of the hub axially towards the end of the shaft, and means for engaging said inner surface of said split ring to secure said ring against said hub.

9. In a cage mill according to claim 8 wherein said stationary and movable portions have cooperative opposed members which form a seal holding assembly externally of said chamber when said portions are in said operative position of said mill, sealing means extending substantially the entire length of said members constructed and arranged to be received and maintained in a proper sealing position by said seal holding assembly of said members.

10. In a cage mill according to claim 9 wherein said sealing means further comprises, a pliable gasket means mounted on one of said members and having an exposed relatively wide penetratable surface, lip means mounted on the other of said members arranged perpendicular to said penetratable surface of said gasket means and having a transverse cross-sectional area substantially smaller than the opposed surface of said gasket means and constructed and arranged to penetrate said gasket thereby establishing a sealing condition, in a manner to allow for a given misalignment of said housing portions when brought to said operative position, and clamping means for maintaining said gasket means and lip means in said sealing condition.

11. In a cage mill according to claim 10 wherein said gasket means is mounted to said member of said stationary portion and said lip means is mounted to said member of said movable portion, and wherein said clamping means includes:

a C-shaped member pivotally mounted at one of its ends to said stationary portion and constructed to partially encircle said seal holding assembly when in its clamping position, means on the other end of said C-shaped member for effecting and adjusting the tightening force of said clamping means against said seal holding assembly, and means for positioning said clamping means into operative and inoperative positions.

12. In a cage mill according to claim 10, wherein said seal holding means further includes means for limiting the positioning of said lip within said gasket.

13. In a cage mill according to claim 8 further comprising:

means on said stationary and movable portions for guiding said movable portion during its movement.

14. In a cage mill according to claim 8 further comprising:

a pair of parallel rows of liner plates mounted within said chamber so as to protect said chamber against the impact of the material being reduced, said rows being made up of reversible pairs of plates each said pair being of substantially equal length and adapted to be rotated so that their outer longitudinal sides can be positioned to assume the position of their inner longitudinal sides, and vice versa, said pair of plates arranged to cover substantially the entire transverse dimension of said chamber, fastening means for retaining each said plate in said chamber, each said fastener means having a holding portion for engaging within said housing said plate and a portion projecting therefrom externally through said housing and means for quickly releasing and securing said projecting portion to the outside of said housing.

15. In a cage mill according to claim 8, including a seal between said stationary portion and said movable portion comprising:

cooperative opposed members one mounted on said stationary portion and one on said movable portion to form a seal holding assembly when said opposed members are in a cooperative position, sealing means extending substantially the entire length of said members constructed and arranged to be received and maintained in a proper sealing position by said seal holding assembly of said portion, said sealing means further comprises:

a pliable gasket means mounted on one of said members and having an exposed relatively wide penetratable surface, lip means mounted on the other of said members arranged perpendicular to said penetratable surface of said gasket means and having a transverse cross-sectional area substantially smaller than the opposed surface of said gasket means and constructed and arranged to penetrate said gasket thereby establishing a sealing condition in a manner to allow for a given misalignment of said portions when brought into said cooperative positioning, and clamping means for maintaining said gasket means and said lip means in said sealing condition.

16. In a cage mill according to claim 8, wherein said chamber is formed with a constant cross-sectional width, two axially opposed shafts each having their one end extended in said chamber, said rotating means comprising cooperative cage assemblies connected to and for rotation with a different one of said shafts and forming a center for receiving said material, each cage assembly comprising the following:

at least two concentric rows of impact members arranged to extend across said cross-sectional width of said chamber, a stepped disk for supporting two rows of associated impact members at their one end and constructed and arranged in a manner to mount said rows of said impact members in radial different portions of a step, said impact members of a first row having a lesser length than those of a second row arranged radially outwardly from said first row and certain impact members being arranged to overlay and be protected by the axially parallel portion of said stepped disk, means for each row for supporting the other end of said impact members, the construction and arrangement of said two cooperative cage assemblies being such that said two rows of a cage assembly alternate with said two rows of the other cage assembly, and said rows define a substantially increasing tapering path of travel for said material outwardly from said center.

17. In a cage mill for disintegrating or reducing materials, comprising:

a housing of a unitized construction being made up of two distinct portions which when caused to assume an operative position for said mill form said unitized construction, said housing also having within it a material reducing chamber for receiving rotating means for reducing said material when introduced into said chamber, said two distinct portions consisting of one portion being stationarily mounted and the other portion being movably mounted relative to the stationary portion, cooperative opposed members, one mounted on said stationary portion and one on said movable portion to form a seal holding assembly externally of said chamber when said portions assume said operative position and when in said operative position said opposed members are in a cooperative spaced apart position, said rotating means consisting of at least two separate cooperating material reducing assemblies each supported on coaxially arranged shafts carried by a different one of said portions, and wherein for the operation of said rotating means, a predetermined axially spaced relationship exists between said two shafts, sealing means extending substantially the entire length of said members constructed and arranged to be received and maintained in a proper sealing position by said seal holding assembly of said portions, said sealing means further comprises;

a pliable gasket means mounted on one of said members and having an exposed relatively wide deformable surface, and lip means mounted on the other of said members arranged perpendicular to said deformable surface of said gasket means and constructed and arranged to compress said gasket thereby establishing a sealing condition, said lip extending in the direction of said movable portion, said surface of said seal engaged by said lip being arranged and having a surface area large enough to allow engagement of said lip when said portions are in alignment and when said portions are out of alignment relative to each other, said seal holding assembly further including a projection means mounted radially outwardly from said lip on one of said members and having a cross-sectional length greater than that of said lip, said projection means extending parallel to said lip for limiting the positioning of said lip within said gasket and for maintaining said space relationship between said shafts, and when said opposed members are in said cooperative spaced apart position, said projection means is further constructed and arranged to cooperate with said opposed members to enclose said sealing means, clamping means for maintaining said gasket means and said lip means in said sealing condition.

18. In a cage mill for disintegrating or reducing material comprising:

a housing forming a material reducing chamber having a constant cross-sectional width, two axially opposed shafts each having their one end extended in said chamber, cooperative cage assemblies connected to and for rotation with a different one of said shafts and forming a center for receiving said material, each cage assembly comprising the following:

at least two concentric rows of impact members arranged to extend across said cross-sectional width of said chamber, a stepped disk for supporting two rows of associated impact members at their one end and constructed and arranged in a manner to mount said rows of said impact members in radial different portions of a step, said impact members of a first row having a lesser length than those of a second row arranged radially outwardly from said first row and certain impact members being arranged to overlay such that a nested relationship is formed, and are protected by the axially parallel portion of said stepped disk, means for each row for supporting the other end of said impact members, the construction and arrangement of said two cooperative cage assemblies being such that said two rows of a cage assembly alternate with said two rows of the other cage assembly, and all of said rows define a substantially increasing tapering path of travel for said material outwardly from said center, said shafts being supported at the other ends outside said housing on support means and said support means of at least one of said shafts including:

a first adjusting means for axially moving said one shaft and its respective cage assembly relative to the other cage assembly for obtaining an operative and an inoperative positioning for said cage assemblies, and a second adjusting means associated with at least one of said shafts for axially moving said at least one shaft and its respective cage assembly when said cage assemblies are in said operative positioning and constructed and arranged to further position said cage assemblies relative to each other to obtain a desired said nesting relationship therebetween, said second adjusting means includes: a plate supported by a part of said support means in a manner to permit movement of said plate axially of said one shaft, shaft carrying means for said one shaft carried by said plate so that said plate and said one shaft move together as a unit, and means for effecting said movement.

19. In a cage mill for disintegrating or reducing material comprising:

a housing forming a material reducing chamber, two axially opposed shafts each having their one end extended in said chamber, each said shaft includes a hub having a bore for mounting on a complimentary portion of said extended end, cooperating cage assemblies connected to and for rotation with a different one of said hubs, means for maintaining each said hub and its respective cage assembly on their respective shaft comprising:

a split ring arranged concentrically with said extended end portion of said shaft and having inner peripheral and outer peripheral load transmitting surfaces, said latter surface engaging with an associated cage assembly in a manner to oppose movement of the hub axially towards the end of the shaft, means for engaging said inner surface of said split ring to secure said ring against said hub.

20. In a cage mill for disintegrating or reducing materials comprising:

a housing of a unitized construction being made up of two distinct portions which when caused to assume an operative position for said mill, form said unitized construction, said housing also having within it a material reducing chamber for receiving rotating means for reducing said material when introduced into said chamber, said two distinct portions consisting of one portion being stationarily mounted and the other portion being movably mounted relative to each other, power means for rotating said rotating means mounted on said movable portion and movable therewith, retracting means including a second power means mounted in said movable portion and movable with said movable portion for causing said movable portion to move toward and away from said stationary portion and wherein said towards position assumes said operative position of said mill, base means forming part of said stationary portion of said housing for supporting said movable portion of said housing during its movement, said housing includes two axially opposed shafts each having their one end extending in said chamber, each said shaft including a hub having a bore for mounting on a complimentary portion of said extended end, said rotating means connected to and for rotation with a different one of said hubs, means for maintaining each said hub and its respective rotating means on their respective shaft comprising:

a split ring arranged concentrically with said extended end portion of said shaft and having inner peripheral and outer peripheral load transmitting surfaces, said latter surfaces engaging with an associated rotating means in a manner to oppose movement of the hub axially towards the end of the shaft, a nut threadably mounted on the outer end of said shaft having an outer peripheral load transmitting surface for engaging said inner surface of said split ring in a manner to oppose movement of the ring axially toward the end of the shaft, said nut having a central opening including a restricting surface, locking means threadably insertable through said opening of said nut into the end of said shaft having a holding member which said nut in the tendency to rotate is caused to engage to prevent rotation thereof.

21. In a cage mill for disintegrating or reducing materials comprising: a housing of a unitized construction being made up of two distinct portions which when caused to assume an operative position for said mill, form said unitized construction, said housing also having within it a material reducing chamber for receiving rotating means for reducing said material when introduced into said chamber, said two distinct portions consisting of one portion being stationarily mounted and the other portion being movably mounted relative to each other, said housing further includes two axially opposed shafts each having their one end extending in said chamber, each said shaft including a hub having a bore for mounting on a complimentary portion of said extended end, said rotating means connected to and for rotation with a different one of said hubs, means for maintaining each said hub and its respective rotating means on their respective shaft comprising:

a split ring arranged concentrically with said extended end portion of said shaft and having inner peripheral and outer peripheral load transmitting surfaces, said latter surfaces engaging with an associated rotating means in a manner to oppose movement of the hub axially towards the end of the shaft, and means for engaging said innersurface of said split ring to secure said ring against the hub.

* * * * *